United States Patent [19]

Hatfield

[11] Patent Number: 4,928,380

[45] Date of Patent: May 29, 1990

[54] APPARATUS FOR TERMINATING A CABLE TO A TWO PART CIRCULAR CONNECTOR

[75] Inventor: John G. Hatfield, Camp Hill, Pa.

[73] Assignee: AMP Incorporated, Harrisburg, Pa.

[21] Appl. No.: 453,439

[22] Filed: Dec. 20, 1989

[51] Int. Cl.[5] ..... H01R 43/00

[52] U.S. Cl. ..... 29/566.3; 29/749; 29/753

[58] Field of Search ..... 29/861, 858, 865, 866, 29/566.1, 566.3, 566.4, 749, 753

[56] References Cited

U.S. PATENT DOCUMENTS 4,505,034 3/1985 Reidt ..... 29/749

4,524,510 6/1985 Brandeau ..... 29/861

*Primary Examiner*—Carl E. Hall

*Attorney, Agent, or Firm*—James M. Trygg

[57] ABSTRACT

An apparatus for assembling a two part circular connector and terminating discrete wires to insulation displacement contacts within the connector. A two part die is used to position and secure the connector parts. The cable is inserted through an opening in the bottom of the die and the wires positioned in respective radial slots that correspond with the contacts. A punch is then brought into engagement with the die to sever the wires to length, fold the wires into wire receiving slots, terminate the wires to the contacts, and assemble the two parts of the connector.

12 Claims, 7 Drawing Sheets

32
30
14
22
31
10
28
26
16
33
18
12
20
18
23
24

APPARATUS FOR TERMINATING A CABLE TO A TWO PART CIRCULAR CONNECTOR

This invention relates to an apparatus for terminating the discrete wires of a cable to a two part circular connector having insulation displacement terminals, and assembling the two part connector.

BACKGROUND OF THE INVENTION

The present invention is related to the following U.S. Patent Applications which are being filed concurrently with this application and are assigned to the present assignee: Ser. No. 453,535, Circular DIN Plug Connector Method; Ser. No. 454,610, Circular DIN Electrical Connector; Ser. No. 453,534, Circular Cross Section DIN Connector and DIN Connector Assembly, all of which are incorporated herein by reference. The present application discloses a novel apparatus for assembling the miniature circular DIN connector and for terminating wire conductors thereto. The circular connector is shown in FIG. 1 as 10 and includes a wire hub part 12 and a contact housing 14. The wire hub part 12 includes a plurality of radial hub slots 16 which extend radially outwardly and terminate in respective locking slots 18. Locating tabs 20 and 22 project from the wire hub and contact housing parts as shown and serve to aid in handling the parts as well as aligning the parts for assembly and the termination of conductors 23 of a cable 24. The wire hub part 12 has a central opening 26 formed along a vertically disposed axis 28, as viewed in FIG. 1. The contact housing 14 includes a plurality of insulation displacement contacts 30, shown in FIG. 5, within its interior which have a one to one correspondence with the radial hub slots 16 and are in alignment therewith when the locating tabs 20 and 22 are in alignment. Each of the insulation displacement contacts is electrically connected to a respective contact pin 32. The contact housing 14 includes a series of cutouts 31 which are spaced to be in alignment with the wire hub slots 16. This permits locating engagement of the inside diameter of the contact housing 12 with the outer diameter 33 of the wire hub part 12 just prior to final mating of the two parts as will be explained in more detail below.

SUMMARY OF THE INVENTION

The present invention is an apparatus for terminating a plurality of conductors of a cable to insulation displacement terminals of a two part circular connector and assembly thereof. The connector includes a wire hub part having a plurality of radial hub slots on a given angular spacing. A contact housing part is provided to mate therewith having a plurality of insulation displacement terminals having a one to one correspondence with the radial hub slots. The apparatus includes a die with an inner cylindrical surface having a major axis, the inner surface terminating in a seat for receiving and positioning the wire hub and contact housing parts in mutual alignment along the major axis. The die includes a plurality of radial die slots intersecting the inner surface on the given angular spacing for receiving the plurality of conductors. A punch is provided having an outer cylindrical surface arranged concentric with the inner surface of the die for undergoing reciprocating movement along the major axis into and out of engagement with the die. The punch includes means for engaging the contact housing part and moving it along the major axis into mating engagement with the wire hub part. The punch also includes means for severing the conductors to the desired length. When the plurality of conductors are arranged, one conductor in each radial hub slot and extending into the radial die slot adjacent thereto, the conductors are severed to length and each conductor positioned in a radial wire hub slot is terminated to a respective insulation displacement terminal.

DETAILED DESCRIPTION OF THE PREFERRED EMBODIMENT

Figure 2:
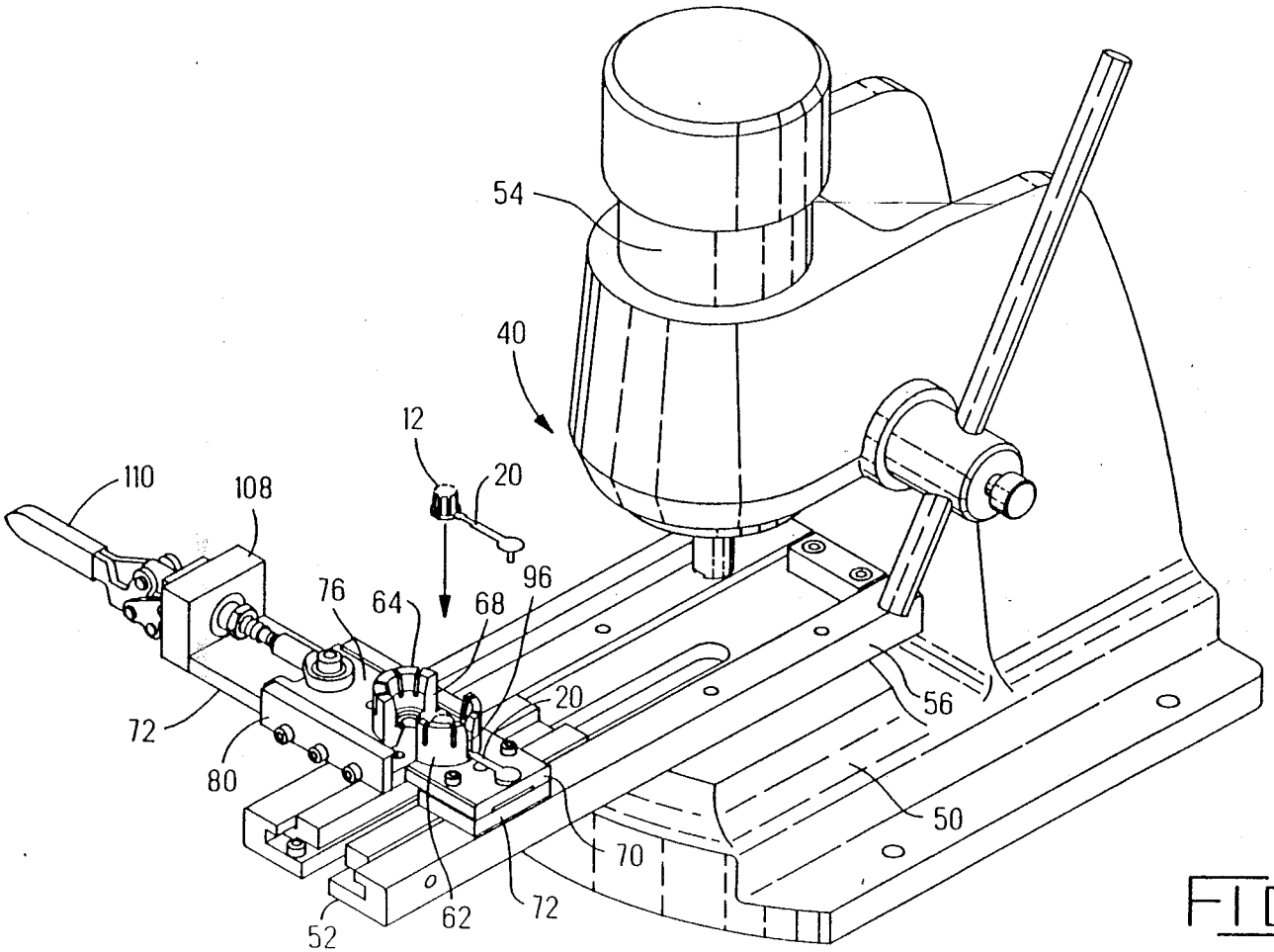
FIG. 2 is an isometric view of the apparatus for assembling the two part connector and cable shown in FIG. 1.
Figure 3:
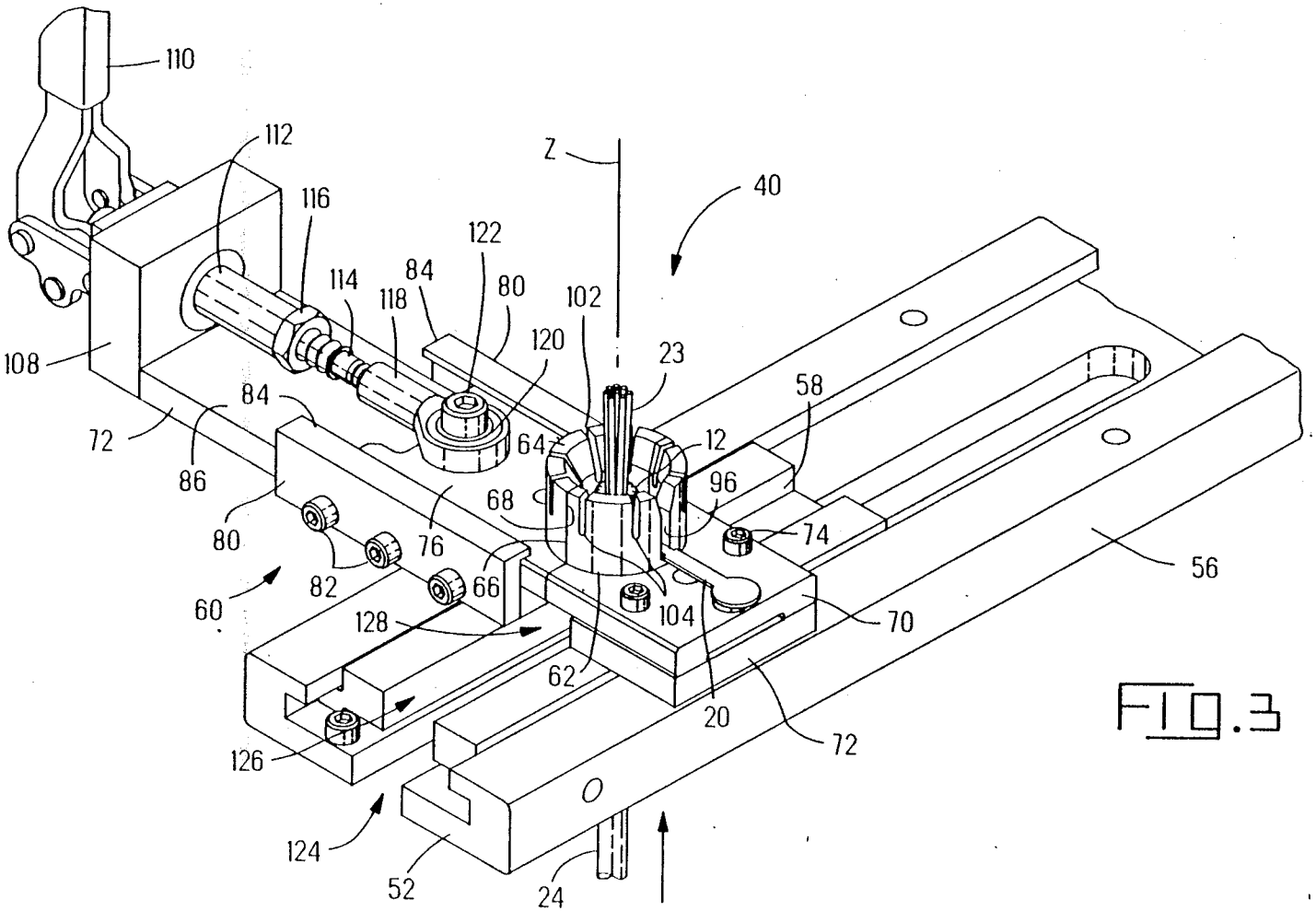
FIG. 3 is a view similar to that of FIG. 2 showing the wire hub part and cable end in place.
Figure 4:
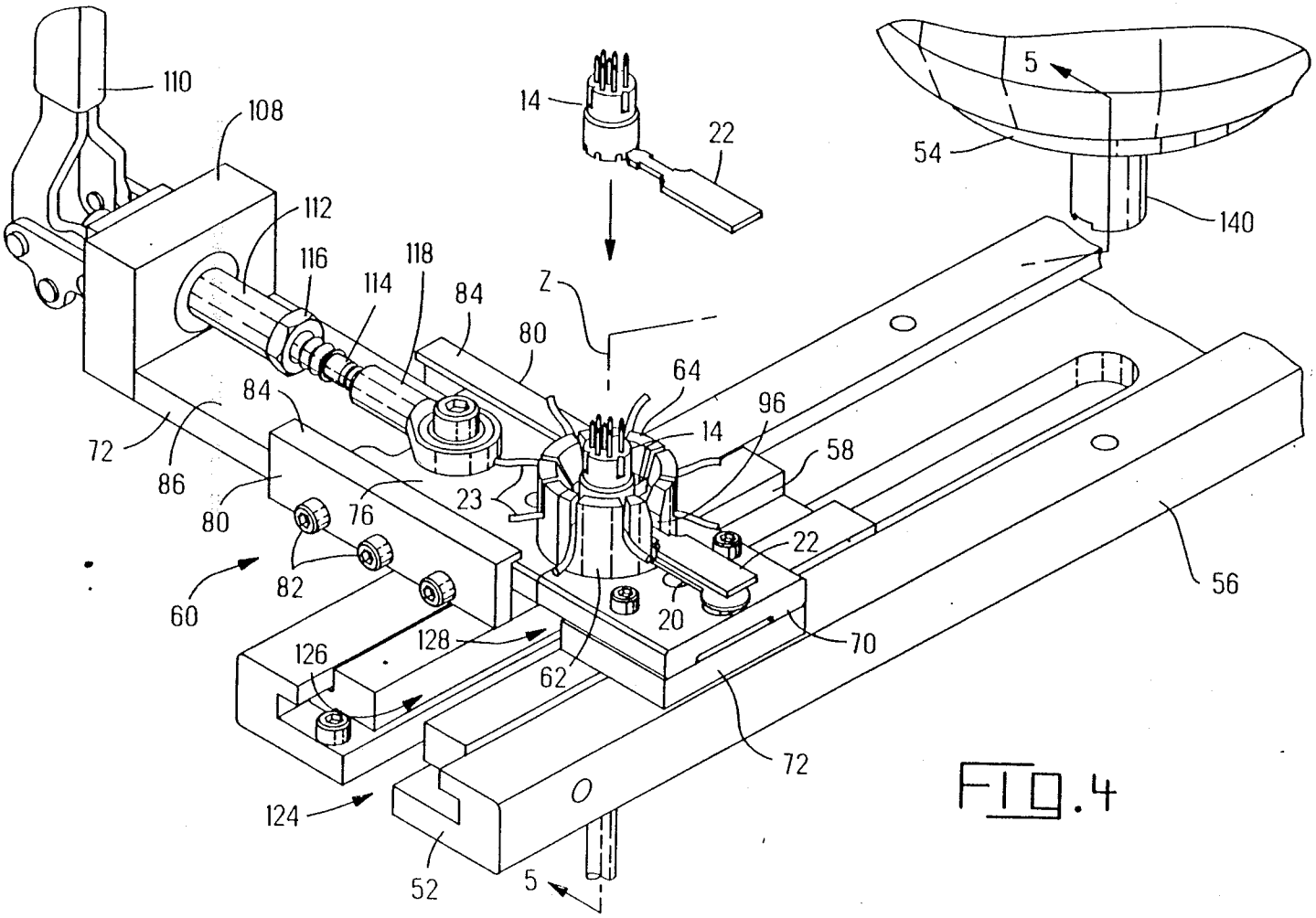
FIG. 4 is a view similar to that of FIG. 3 showing the conductors in the radial die slots and the contact part in place.

There is shown in FIGS. 2, 3 and 4 a tool 40 for terminating conductors 23 of a cable 24 to a two part circular connector having a wire hub part 12 and a contact housing part 14. The tool 40 includes a base 50 and a ram 54 arranged for reciprocating motion relative to the base. The ram 54 may be manually operated as in the present example or any suitable press having a powered ram may be advantageously utilized in the practice of the present invention. A stationary portion 52 of a slide is attached to the base 50 so that the ram 54 is positioned vertically over and near an end 56 of the stationary portion 52. A movable portion 58 of the slide is arranged to move from an open position, as shown in FIG. 2 to a closed position where the movable portion 58 is directly under the ram 54.

Figure 5:
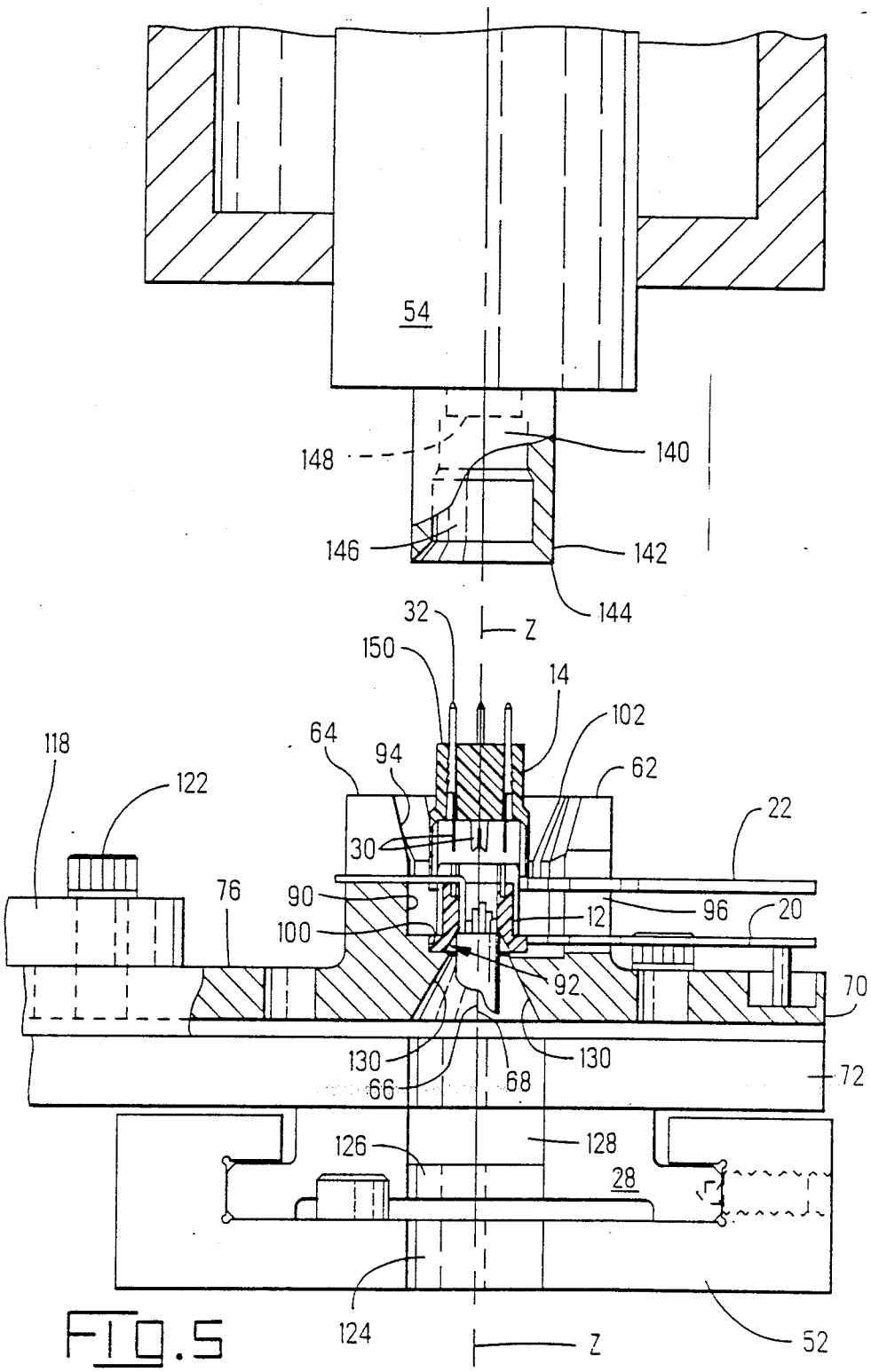
FIG. 5 is a partial cross-sectional view taken along the line 5—5 of FIG. 4 showing the two connector parts and conductors in place prior to termination.
Figure 9:
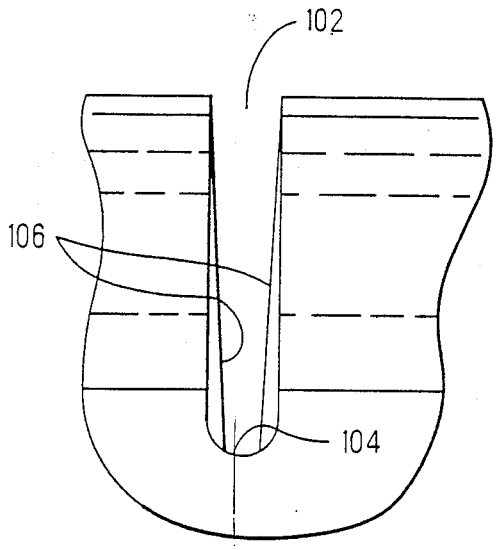
FIG. 9 is a view of a portion of the die showing details of a radial die slot as viewed from the center of the die.

The slide portion 58 carries a die holder 60 for holding a two part die having a stationary half 62 and a movable half 64 with opposing mating surfaces 66 and 68 respectively. The stationary half 62 is integral with a mounting plate 70 which is attached to a base plate 72 by means of the screw fasteners 74. The base plate 72 is attached to and is carried by the movable slide portion 58 by suitable screw fasteners, not shown. The movable die half 64 is integral with a movable support plate 76 which is arranged to move toward and away from the mounting plate 70 within the confining limits of a pair of guide rails 80. As shown in FIGS. 2, 3 and 4 the guide rails 80 are attached to opposite sides of the base plate 72 by means of the screw fasteners 82 so that they are in opposing spaced relationship. Each guide rail 80 has a shoulder 84 which overhangs the movable support plate 76 thereby holding it in sliding engagement with the surface 86 of the base plate 72. With the movable support plate 76 fully extended toward the mounting plate 70, the opposing mating surfaces 66 and 68 are in abutting engagement as shown in FIG. 5. In this position the two die halves 62 and 64 form an inner cylindrical surface 90 having a major axis Z. The cylindrical surface 90 terminates at its bottom in a seat 92 for receiving the wire hub part 12 and terminates at its upper end in a diverging chamfer 94. A locating slot 96 is formed in the side of the die half 62 and is sized to closely receive a portion of the locating tabs 20 and 22 when the wire hub and contact housing parts 12 and 14 are seated within the seat 92 as shown in FIGS. 4 and 5. The locating slot 96 angularly positions the wire hub and contact housing parts 12 and 14 within the die halves 62,64. The seat 92 has a locating diameter 100 for positioning the wire hub part 12 in alignment with the major axis Z of the inner cylindrical surface 90 and for holding the wire hub part firmly in place. A plurality of radial slots 102 are formed in die halves 62 and 64, radiating outwardly from the axis Z. The slots 102 begin at the upper surfaces of the die halves 62,64 and extend downwardly beyond the chamfer 94 and into the inner cylindrical surface 90 to a lower edge 104. The radial slots 102 are angularly spaced so that each slot 102 is opposite to and in radial alignment with a respective radial hub slot 16 of a wire hub part 12 properly positioned within the seat 92. Each radial slot 102 includes a pair of wire gripping surfaces 106 which converge toward the bottom of the slot as best seen in FIG. 9. The surfaces 106 are spaced apart an amount that permits the wire 23 to be captured and held in place when the wire is inserted into the slot and pulled firmly down toward the bottom as shown in FIG. 4.

The movable support plate 76 is movable from its open position where the two die halves 62 and 64 are apart, as shown in FIG. 2, to its closed position where the surfaces 66 and 68 are in abutting engagement as shown in FIG. 3. This movement is effected by a toggle clamp 110 which is manually actuated to cause a piston 112 to undergo linear movement. The clamp 110 is attached, by means of screw fasteners, not shown, to a mounting block 108 through which the piston 112 reciprocates. The block 108 is attached to the end of the base plate 72 by any suitable means. A stud 114 has one end threaded into an axially disposed hole, not shown, that is formed in the end of the piston 112 and locked in place with the locknut 116. The other end of the stud 114 is threaded into another hole, not shown, of a rod end spherical coupling 118. The spherical member 120 of the rod end coupling 118 is fastened to the movable support plate 76 by means of the screw fastener 122. The threads on one end of the stud 114 are of one pitch while the threads on the other end are of another pitch. This permits adjusting the stroke of movement of the support plate 76 by rotating the stud 114 in one direction to displace the movement toward the mounting plate 70 and in the other direction to displace the movement away from the mounting plate 70.

There are U-shaped clearance slots 124,126, and 128 formed in the slide portions 52 and 58 and the base plate 72 respectively. The slots 124,126, and 128 are vertically disposed one over the other with their narrow dimension approximately centered with respect to the axis Z and their longitudinal dimension being sufficiently long to clear the cable 24 when the slide portion 58 is moved to its closed position under the ram 54. As shown in FIG. 5, the plates 70 and 76 have a frustoconical opening 130 formed along the axis Z with its smaller end adjacent the seat 92, the opening extending through the seat.

A cylindrically shaped punch 140 is secured to the ram 54 in the usual manner so that when the slide portion 58 is moved to its closed position under the ram, the punch 140 is in vertical alignment with the axis Z of the cylindrical surface 90. The outer diameter of the surface 142 of the punch 140 is very slightly smaller than the diameter of the cylindrical surface 90 when the two die halves 62 and 64 are matingly engaged. This permits the edge 144 and the lower edges 104 of the slots 102 to act as shears to sever individual wires 23 that are held in place within the slots. The punch 140 includes a clearance cavity 146 sized for loosely receiving the contact housing 14. A shoulder 148 is provided within the cavity 146 to abuttingly engage the top surface 150 of the contact housing 14 when completing the assembly of the two parts.

Figure 1:
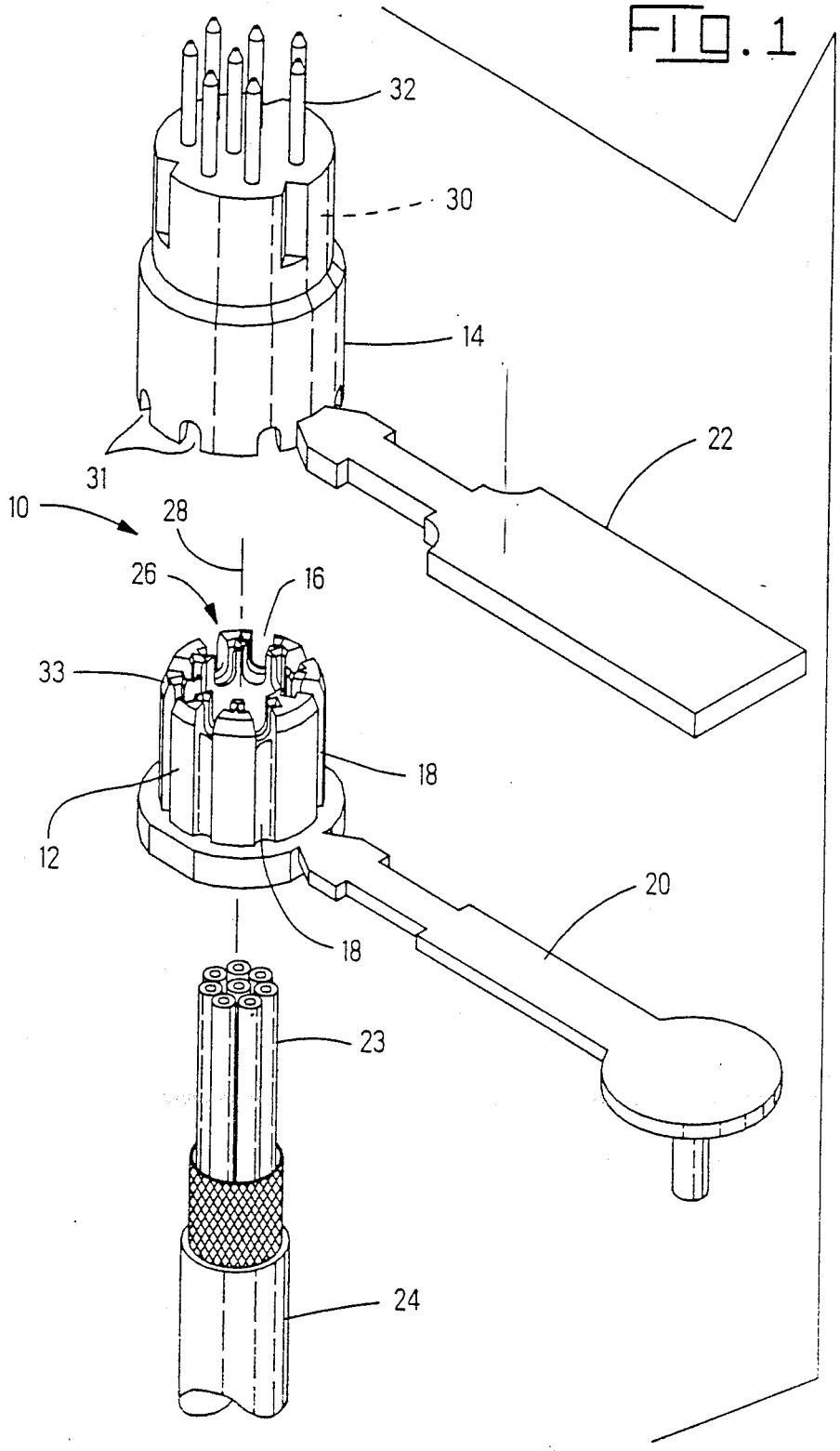
FIG. 1 is an isometric view showing a two part circular connector and prepared cable end prior to assembly.

In operation, the slide portion 58 is moved away from the ram 54 to its open position as shown in FIG. 2. The movable plate 72 is retracted away from the support plate 70 thereby opening the two die halves 62 and 64. A wire hub part 12 is then lowered into the seat 92 in the die half 62 with the locating tab 20 positioned within the locating slot 96, as shown in FIG. 2. The clamp 110 is then actuated causing the rod end coupling 118 to advance the movable plate 76 and associated die half 64 into mating engagement with the die half 62 where the surfaces 66 and 68 are in tight abutting engagement. This causes the diameter 100 of the seat 92 to clamp the wire hub part 12 therein and in alignment with the axis Z. The cable 24 is then prepared as shown in FIG. 1 and inserted up through the frustoconical opening 130 and through the wire hub opening 26 so that the wires 23 extend above the die halves 62 and 64 a suitable distance as shown in FIG. 3. The individual wires 23 are then fanned out and individually placed in their respective radial slots 102 according to their wire identification codes. Each wire 23 is pulled down tightly in its slot 102 so that the wire is held securely between the converging surfaces 106 as shown in FIG. 9. In doing this, the wires 23 are made to nestle into their respective wire hub slots 16. The contact housing part 14 is then lowered onto the wire hub part with the locating tab 22 positioned in the locating slot 96 as shown in FIG. 4. Note that the series of cutouts 31 are in alignment with the wires 23 permitting the inside diameter of the contact housing part 14 to locatingly engage the outer diameter 33 of the wire hub part 12, as best seen in FIG. 5.

Figure 6:
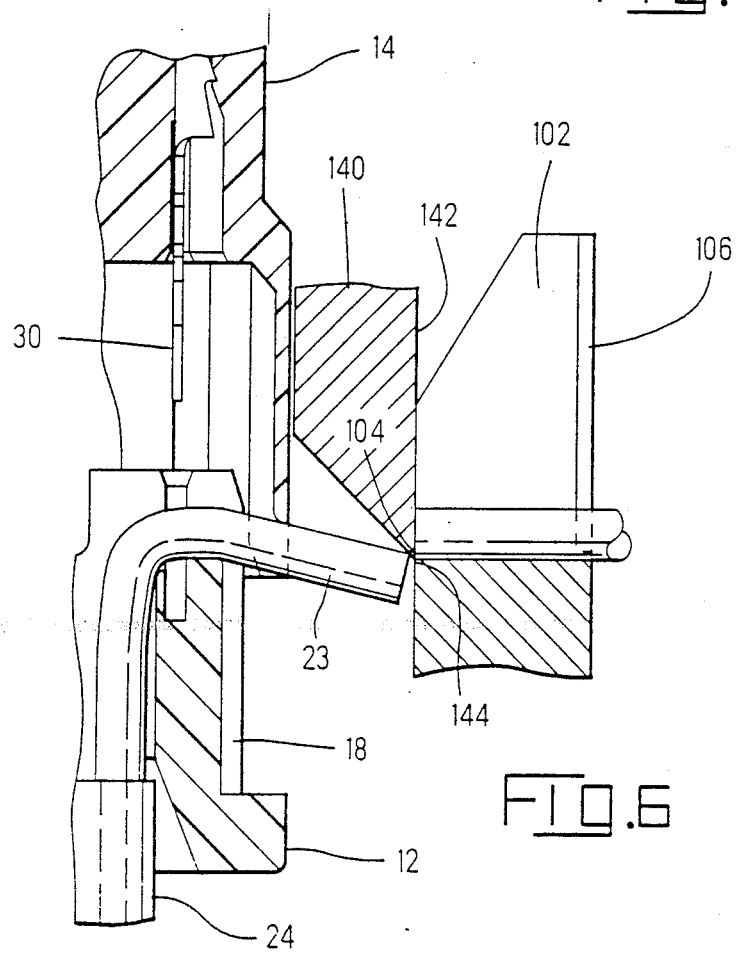
FIGS. 6, 7, and 8 are cross-sectional views of a portion of the die and punch showing the severing of a conductor and its termination to an insulation displacement terminal.
Figure 7:
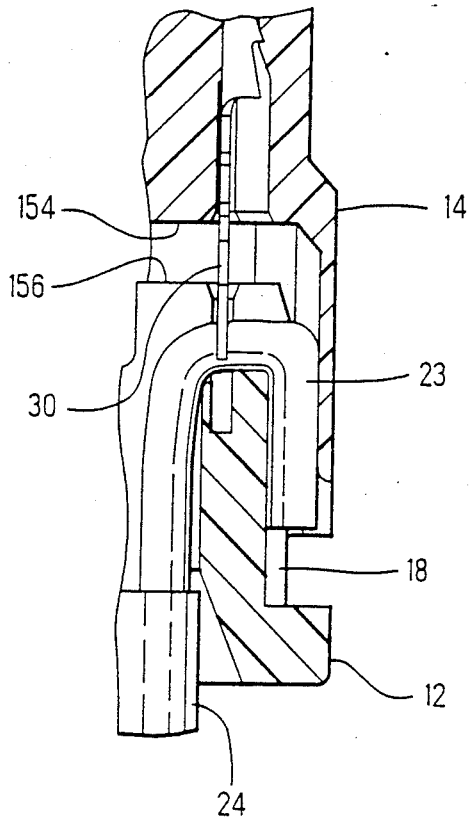
Figure 8:
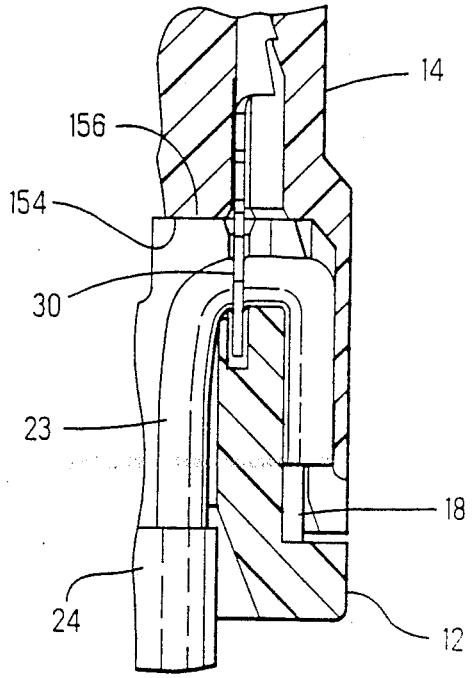

The slide portion 58 is then moved to its closed position under the ram 54 so that the axis Z coincides with the axis of the punch 140. The ram 54 is then operated to move the punch 140 downwardly toward the closed die halves 62 and 64. As the outer diameter 142 enters the die 62,64 the edge 144 engages the wires 23 disposed in the radial die slots 102 severing them against the corresponding edges 104, as shown in FIG. 6. As downward motion of the punch 140 continues, the wires 23 are forced to fold downwardly and the surface 148 of the punch 140 engages the top surface 150 of the contact housing part 14 pushing it downwardly. This downward movement of the contact housing part 14 folds the wires 23 into their respective locking slots 18 as seen in FIG. 7. Note that, at this point, the insulation displacement contacts 30 are just beginning to engage the wires 23. As downward motion continues, the contacts 30 fully engage the wires 23 making electrical contact with the conductors and the surfaces 154 and 156 of the contact housing and the wire hub parts 14 and 12 respectively abuttingly engage. The ram 54 and punch 140 are then withdrawn and the slide portion 58 moved outwardly to its open position and the clamp 110 actuated to move the support plate 76 away from the mounting plate 70 thereby opening the two die halves 62 and 64. The severed ends of the wires 23 held between the surfaces 106 in the slots 102 are removed and discarded. The cable 24 with attached connector is removed and the process repeated any desired number of times.

An important advantage of the present invention is that the wire hub and contact housing parts are automatically and accurately positioned within the tool 40 with only minimal operator skill. Another important advantage is that the split die 62,64 both locates and clamps in place the wire hub part 12 so that as the cable 24 is inserted from the bottom through the wire hub and the conductors positioned in the radial slots, the wire hub part remains in alignment within the die 62,64. Another advantage is that with a single stroke of the ram, the wire hub part 12 and the contact housing 14 are assembled and the individual wires 23 are terminated to their respective contacts 30, including cutting the wires 23 to length and folding them into the slots 18. This is accomplished with only a single punch and die combination.

I claim:

1. An apparatus for terminating a plurality of conductors of a cable to insulation displacement terminals of a two part circular connector and assembly thereof, said connector including a wire hub part having a plurality of radial hub slots on a given angular spacing and a contact housing part having a plurality of insulation displacement terminals on said given angular spacing and having a one to one correspondence with said radial hub slots, the apparatus comprising:

(a) a die with an inner cylindrical surface having a major axis, said inner cylindrical surface terminating in a seat for receiving and positioning both said wire hub part and said contact housing part in mutual alignment along said major axis, said die including a plurality of radial die slots intersecting said inner cylindrical surface on said given angular spacing for receiving said plurality of conductors; and (b) a punch having an outer cylindrical surface arranged concentric with said inner cylindrical surface for reciprocating movement along said major axis into and out of engagement with said die, said punch including means for engaging said contact housing part and moving it along said major axis into mating engagement with said wire hub part and means for severing said conductors to length, so that when said plurality of conductors are arranged one conductor in each radial hub slot and extending into said radial die slot adjacent thereto, said conductors are severed to length and each said conductor positioned in a radial wire hub slot is terminated to a respective insulation displacement terminal.

2. The apparatus according to claim 1 wherein said seat includes an opening for receiving an end of said cable and positioning said plurality of conductors within said inner cylindrical surface.

3. The apparatus according to claim 1 wherein said means for severing said conductors to length includes an edge of said outer cylindrical surface in shearing engagement with said inner cylindrical surface at the points where said radial die slots intersect therewith.

4. The apparatus according to claim 1 including means for holding said plurality of conductors in said radial die slots during severing thereof and for holding the severed ends therein.

5. The apparatus according to claim 4 wherein said means for holding comprises a constricted portion in each of said radial die slots formed by opposite portions of the walls of each radial die slot converging toward the bottom thereof.

6. The apparatus according to claim 5 wherein said constriction is spaced from said inner cylindrical surface.

7. The apparatus according to claim 2 including means for securing said wire hub part in said seat.

8. The apparatus according to claim 7 wherein said die comprises a first die half and a second die half having opposed mating surfaces each containing a portion of said seat, and said means for securing said wire hub part in said seat comprises slide means for moving one of said first and second die halves from an open position where said opposed mating surfaces are apart to a closed position where said opposed mating surfaces are in close proximity thereby wedging said wire hub part between said portions of said seat.

9. The apparatus according to claim 8 wherein said slide means moves said first die half and wherein said second die half includes a locating slot for receiving a locating tab on said wire hub part and a locating tab on said contact housing so that when said two locating tabs are received in said locating slot both said wire hub part and said contact housing part are in mutual alignment along said major axis

10. The apparatus according to claim 8 wherein only a portion of said opening in said seat is in one of said first and second die halves.

11. The apparatus according to claim 10 wherein said major axis intersects the approximate center of said opening in said seat.

12. The apparatus according to claim 1 including means for moving said die from a first position substantially out of alignment with said punch for receiving said wire hub part and said contact housing part to a second position where said inner cylindrical surface of said die is substantially concentric and in alignment with said outer cylindrical surface of said punch.

* * * * *